US007850292B2

(12) United States Patent
Wada

(10) Patent No.: US 7,850,292 B2
(45) Date of Patent: Dec. 14, 2010

(54) FLOW PATH CONNECTING DEVICE AND RECORDING APPARATUS

(75) Inventor: Toshihide Wada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 367 days.

(21) Appl. No.: 12/145,431

(22) Filed: Jun. 24, 2008

(65) Prior Publication Data

US 2009/0009568 A1 Jan. 8, 2009

(30) Foreign Application Priority Data

Jul. 3, 2007 (JP) ..... 2007-175294

(51) Int. Cl.
*B41J 2/175* (2006.01)

(52) U.S. Cl. ..... 347/85; 347/84

(58) Field of Classification Search ..... 347/84–86
See application file for complete search history.

(56) References Cited

U.S. PATENT DOCUMENTS 6,099,112 A 8/2000 Olazabal
6,224,198 B1 * 5/2001 Cook et al. ..... 347/85
2002/0109758 A1 * 8/2002 Kono ..... 347/85
2004/0001126 A1 1/2004 Oda

FOREIGN PATENT DOCUMENTS

CN 1467089 1/2004
JP 2002-113879 A 4/2002

* cited by examiner

*Primary Examiner*—Ellen Kim
(74) *Attorney, Agent, or Firm*—Canon USA Inc IP Div

(57) ABSTRACT

A flow path connecting device includes a first flow path having a first connector and configured to channel fluids, a second flow path having a second connector and configured to channel fluids, a moving unit configured to move at least one of the first and second connectors, to interconnect the first and second connectors so that the first and second flow paths are communicated with each other, and to separate the first and second connectors from each other, and a control unit configured to control the moving unit, when the first and second connectors separate from each other, to set a relative speed of the first and second connectors to a first speed or less in a period from a start of the separation till a lapse of predetermined time, and set the relative speed to a second speed that is higher than the first speed after the lapse of the predetermined time.

21 Claims, 11 Drawing Sheets

FLOW PATH CONNECTING DEVICE AND RECORDING APPARATUS

BACKGROUND OF THE INVENTION

1. Field of the Invention

The present invention relates to a flow path connecting device for automatically interconnecting flow paths of liquids to communicate with each other or for separating the flow paths from each other, or to a recording apparatus for supplying inks from the outside of a carrier including the flow path connecting device.

2. Description of the Related Art

A recent printing apparatus for a business purpose is expected to reduce the number of replacing times and running costs, so that a large capacity is required of an ink tank that contains a printing ink.

An apparatus that performs printing by moving a carrier having a printing mechanism in a direction perpendicular to a printing sheet feeding direction generally mounts an ink tank on the carrier.

However, this method has disadvantages, for example, if size of the carrier or weight of the ink tank is increased the speed of the carrier will decrease, or the size of a carrier motor must be increased to compensate for the reduction in speed. To solve such a problem, the ink tank can be arranged separately from the carrier, and the carrier printing mechanism and the ink tank can be interconnected through a tube.

In such a tube connection method, the length of the tube needs to be set in anticipation of carrier movement. This method also has problems such as a detrimental influence of tube rigidity on the carrier movement, incursion of air into the ink from the outside of the tube, and evaporation of ink water to the outside of the tube, which makes it difficult to select a tube material.

As an example of a solution to the aforementioned problems, an ink supply mechanism is discussed in Japanese Patent Application Laid-Open No. 2002-113879. In this ink supply mechanism, a connection mechanism that divides an ink supply path is disposed between an apparatus main-body having a large-capacity ink tank and a moveable carrier having a printing mechanism. The connection mechanism at main-body side and the connection mechanism at a carrier-side are configured such that an ink flow path is formed to supply the ink to the carrier side when connected together, and leakage of the ink from each connection mechanism can be prevented when separated from each other.

However, in the case of the supply mechanism and the operation discussed in Japanese Patent Application Laid-Open No. 2002-113879, there is a possibility that when the connection mechanisms are separated from each other, the ink left in each connection mechanism will scatter and contaminate a printing sheet.

SUMMARY OF THE INVENTION

The present invention is directed to a mechanism for preventing or reduce the scattering of the ink from such a connection portion.

According to an aspect of the present invention, a flow path connecting device includes a first flow path having a first connector and configured to channel fluids, a second flow path having a second connector and configured to channel fluids, a moving unit operable to move at least one of the first and second connectors, to interconnect the first and second connectors so that the first and second flow paths are communicated with each other, and operable to move at least one of the first and second connectors to separate the first and second connectors from each other, and a control unit configured to control the moving unit, when the first and second connectors separate from each other, to set a relative speed of the first and second connectors to a first speed or less in a period from a start of the separation till a predetermined time expires, and set the relative speed to a second speed that is higher than the first speed after the predetermined time expires.

According to an exemplary embodiment of the present invention, scattering of fluids caused when the first connector of the first flow path and the second connector of the second flow path are separated from a connected state can be reduced.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will now be described in detail with reference to the drawings.

Figure 9:
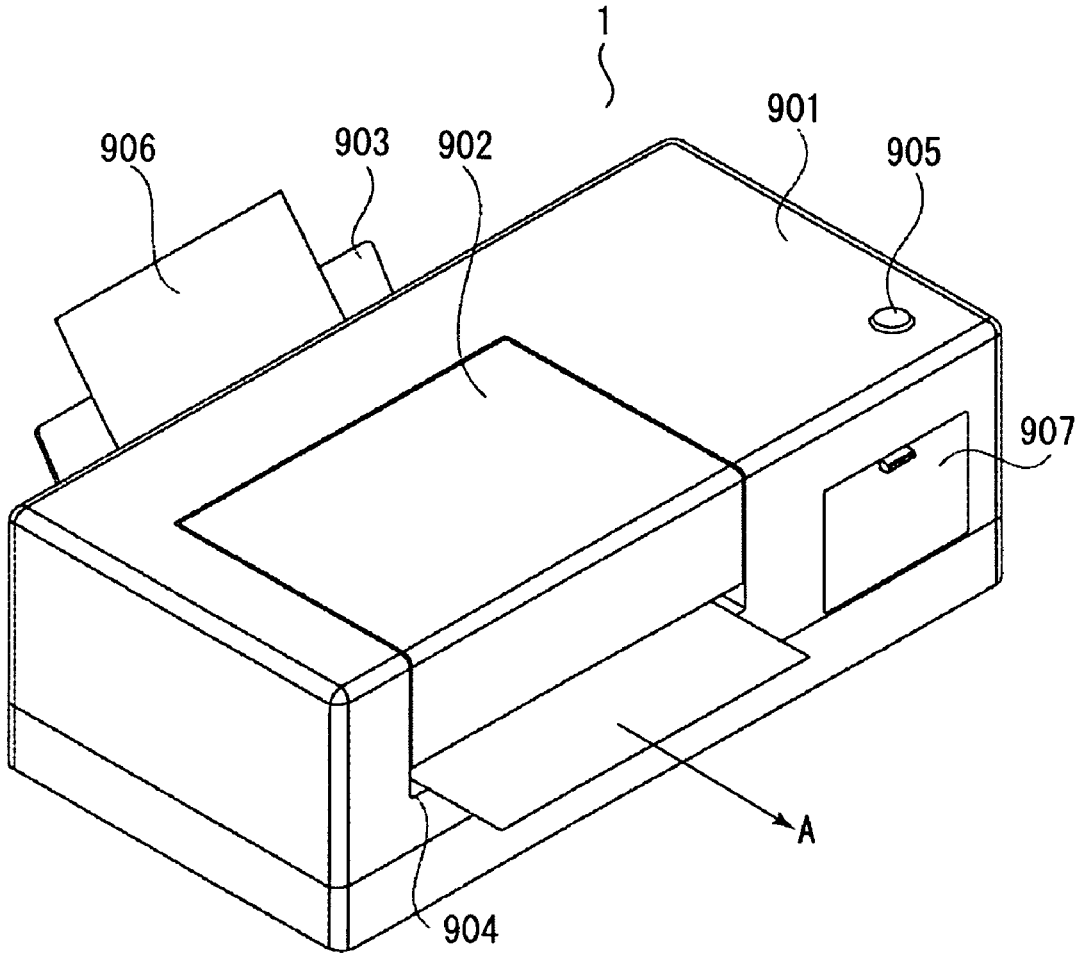
FIG. 9 is a perspective diagram illustrating an outer appearance of the printing apparatus according to the exemplary embodiment of the present invention.
Figure 10:
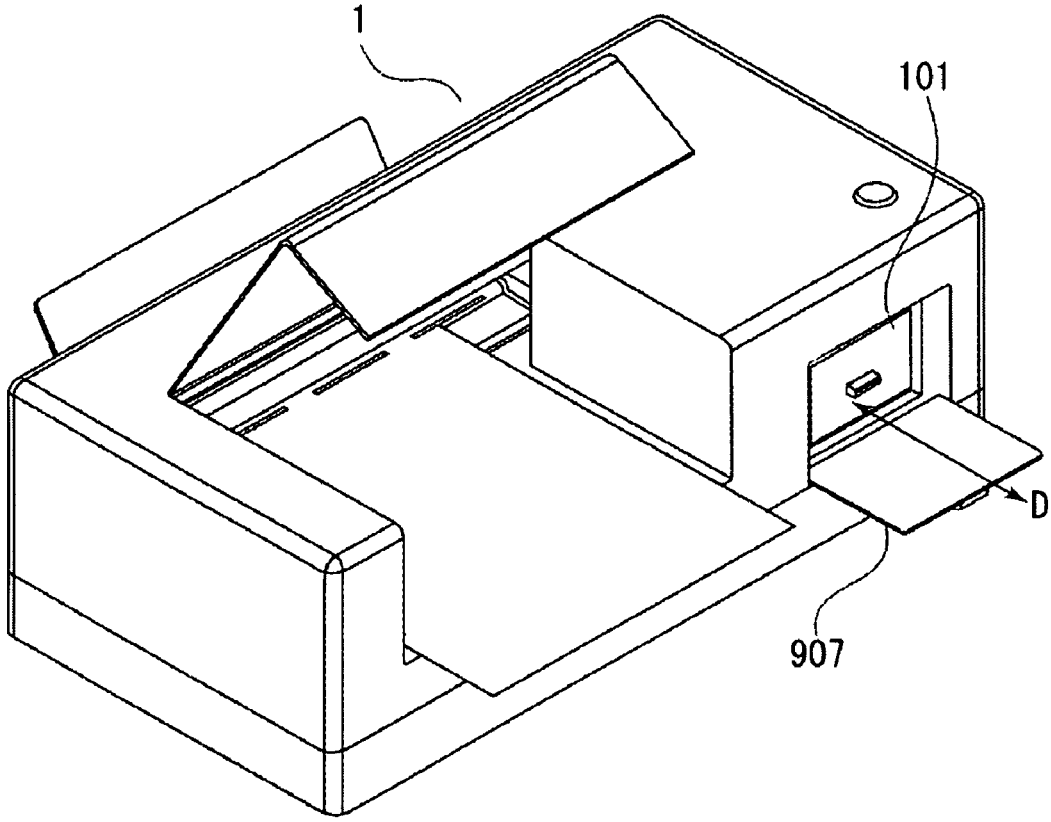
FIG. 10 is a perspective diagram illustrating an outer appearance of the printing apparatus according to the exemplary embodiment of the present invention.

FIGS. 9 and 10 are perspective diagrams each illustrating an outer appearance of a printing apparatus (recording apparatus) 1 according to an exemplary embodiment of the present invention.

The printing apparatus 1 includes a casing cover 901, a maintenance cover 902, a guide 903 for supporting a print sheet 906, and a discharge port 904 for discharging the print sheet 906 which is a printed recording medium. The print sheet 906 is discharged in an arrow direction A.

Figure 3:
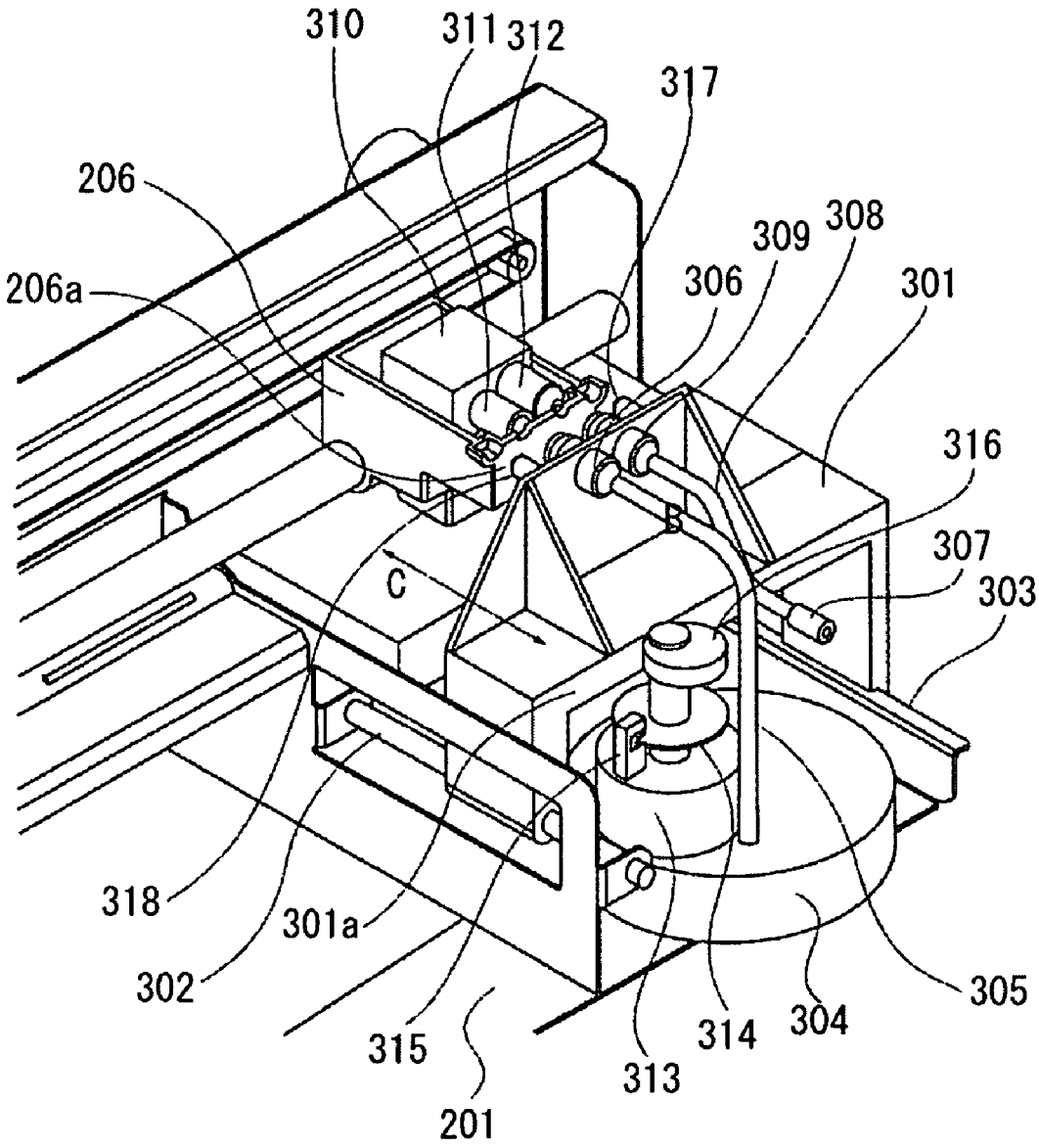
FIG. 3 is a perspective diagram illustrating a carrier portion and an ink supply mechanism of the printing apparatus according to the exemplary embodiment of the present invention.

The printing apparatus 1 further includes a cover 907 for replacing an ink tank 101 that is replaceably installed in a casing to reserve a liquid. In a state that the cover 907 is open as illustrated in FIG. 10, the ink tank 101 is guided in an arrow direction D. When pushed into the casing cover 901 side, the ink tank 101 is coupled with a supply port 307 (FIG. 3). The printing device 1 includes a power switch 905.

Figure 2:
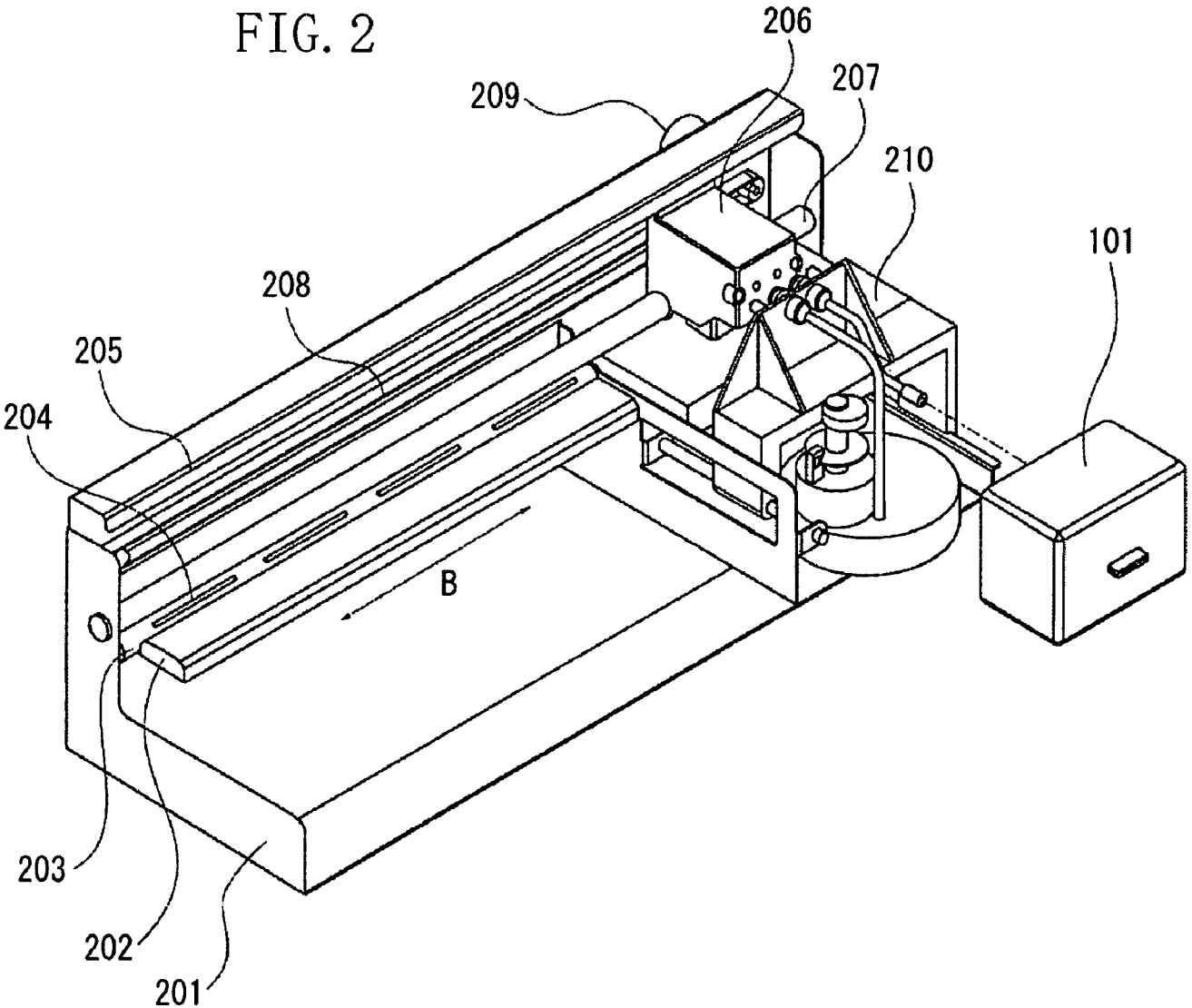
FIG. 2 is a perspective diagram illustrating an internal configuration of a printing apparatus according to an exemplary embodiment of the present invention.

FIG. 2 is a perspective diagram illustrating an internal configuration of the printing apparatus 1. A chassis 201 supports the entire internal configuration. A platen 202 supports the print sheet 906. A roller 203 feeds the print sheet 906. A pinch roller 204 presses the print sheet 906 to the roller 203. By rotating the roller 203 by a driving device (not shown), the print sheet 906 is fed in the arrow direction A of FIG. 9.

A carrier 206 is supported to move reciprocally along a shaft 207 and a guide 205 in an arrow direction B. A motor 209 reciprocates the carrier 206 along the shaft 207 and the guide 205 in the arrow direction B via a belt 208. A maintenance mechanism 210 is configured to maintain a printing mechanism mounted on the carrier 206.

Figure 11:
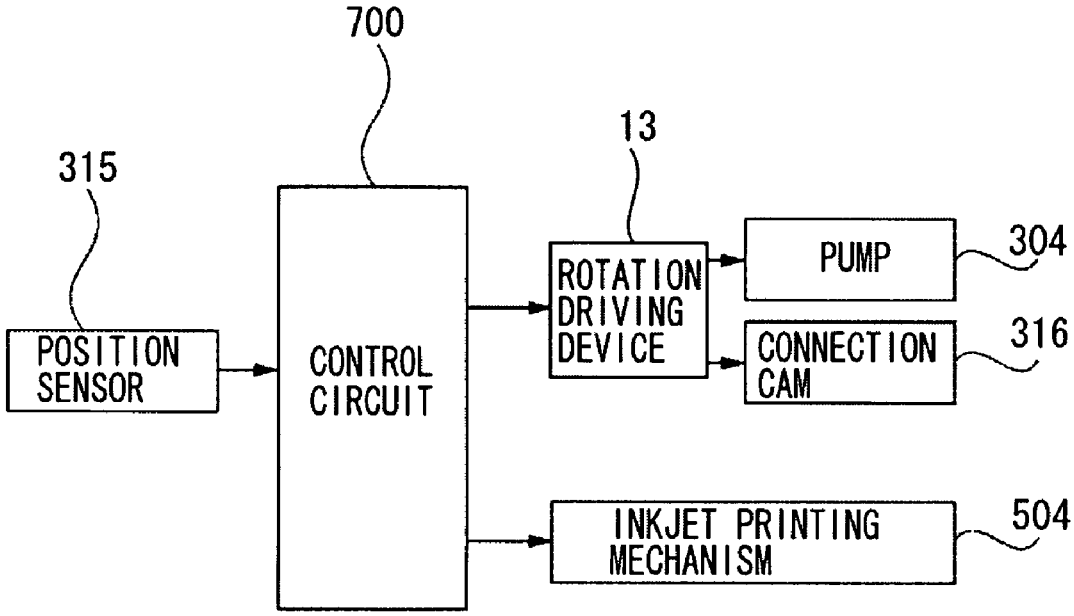
FIG. 11 is a control block diagram of the printing apparatus according to the exemplary embodiment of the present invention.

FIG. 3 is a perspective diagram illustrating a carrier portion of the printing apparatus 1 and an ink supply mechanism of a printing apparatus main-body side. FIG. 11 is a control block diagram of the printing apparatus 1.

A main-body side supply mechanism 301 includes a mechanism of supplying inks as fluids or liquids to the carrier 206 from the outside. The main-body side supply mechanism 301 is supported by a shaft 302 and a guide 303 supported on the chassis 201 to move reciprocally in an arrow direction C perpendicular to the moving direction B of the carrier 206.

A pump 304 serves as a pressure reducing unit for generating negative pressure to form an ink flow. The negative pressure is connected through a tube 305 and a negative pressure connection unit 306 to the main-body side supply mechanism 301.

A supply port 307 is connected with the ink tank 101. By pushing-in the ink tank 101 toward the casing cover 901, the ink tank 101 is coupled with the supply port 307 so that no ink leakage will occur.

The supply port 307 is connected through a tube 308 and a negative pressure valve 309 to the main-body side supply mechanism 301. A sub-ink tank 310 serves as a liquid chamber on the carrier 206 side. Negative pressure valves 311 and 312 are attached to the sub-ink tank 310.

A rotation driving device 313 moves reciprocally the main-body side supply mechanism 301 in the arrow direction C and drives the pump 304. A driving direction of the pump 304 is not limited to a rotational direction of the rotation driving device 313, and the main-body side supply mechanism 301 side is configured to transmit driving force only in one direction by a one-way clutch (not shown).

A connection cam 316 is driven and rotated by the rotation driving device 313. A cam surface of the connection cam 316 abuts on a side face 301*a* of the main-body side supply mechanism 301, and rotates to move the main-body side supply mechanism 301 closer to the carrier 206. Then, the negative pressure valve 309 and a part of the negative pressure connection unit 306 are moved to a position where they abut on a backside 206*a* of the carrier 206. When a small-diameter part of the connection cam 316 rotates up to an initial position where the small-diameter part abuts on the side face 301*a*, the main-body side supply mechanism 301 is moved away from the carrier 206 under a spring force, and the negative pressure valve 309 and the negative pressure connection unit 306 are separated from the backside 206*a* of the carrier 206. The connection cam 316 and the spring constitute a moving unit. A disk 314 rotating integrally with the connection cam 316 includes a notch formed in a predetermined position. The notch is detected by a position sensor 315 to control a rotational angle phase of the connection cam 316.

The rotation driving device 313 and the position sensor 315 are connected to a control circuit 700 (FIG. 11) via wiring lines (not shown) to be controlled by the circuit 700.

Figure 4A:
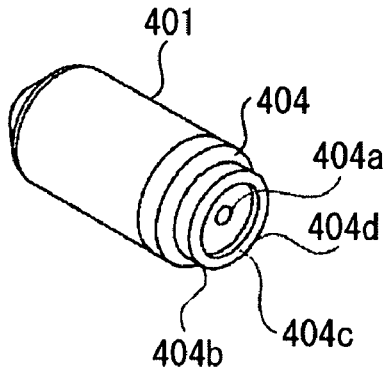
FIGS. 4A and 4B are perspective and sectional diagrams illustrating a negative pressure valve according to the exemplary embodiment of the present invention.
Figure 4B:
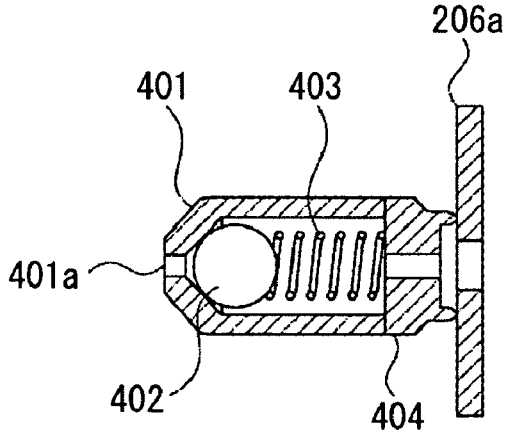

FIGS. 4A and 4B are perspective and sectional diagrams of the negative pressure connection unit 306 and the negative pressure valve 309. The configuration includes a cylinder 401, a sealing member 404 made of an elastic material, and a spherical valve 402. The spherical valve 402 is biased to abut on a slope surface within the cylinder 401 by a spring 403 and holds a pressure difference between a communication port 401*a* side bored in the cylinder 401 and a communication port 404*a* side bored in the sealing member 404 side with a contact surface.

However, the negative pressure connection unit 306 does not include the spherical valve 402 and the spring 403 but includes only the cylinder 401 and the sealing member 404.

The pressure difference shows a relation, communication port 401*a* side pressure>sealing member 404 side pressure, and is determined by setting of the spring 403. When the pressure difference exceeds the retaining force of the spring 403, the spherical valve 402 moves away from the slope surface in the cylinder 401 so that the communication port 401*a* side is communicated with the sealing member 404 side.

When a sealing surface 404*c* of a rib 404*b* of the sealing member 404 abuts on a backside 206*a* of the carrier 206, the rib 404*b* deforms to provide an air-tight seal.

Figure 5A:
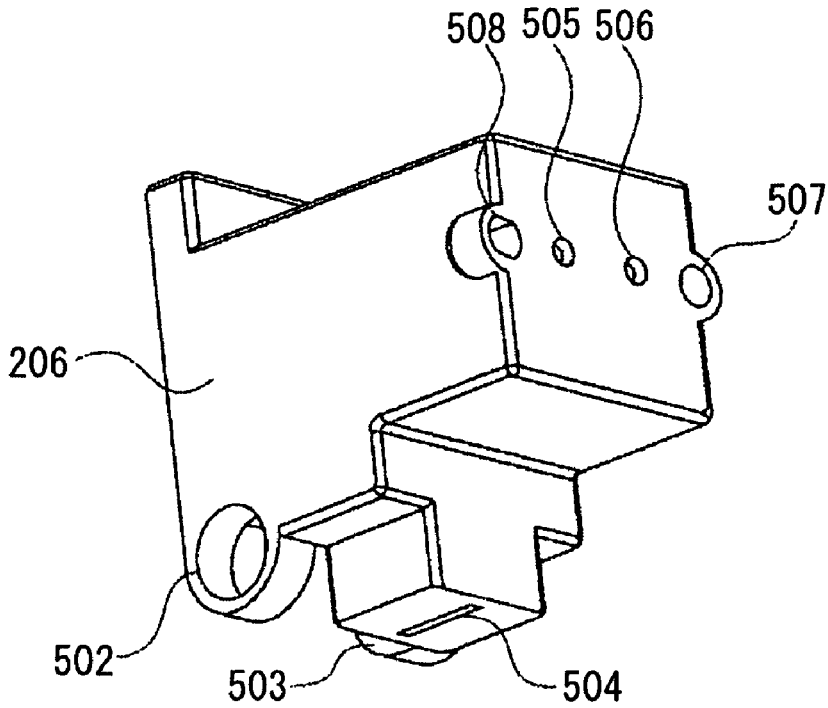
FIGS. 5A and 5B are perspective and partially sectional diagrams illustrating a carrier according to the exemplary embodiment of the present invention.
Figure 5B:
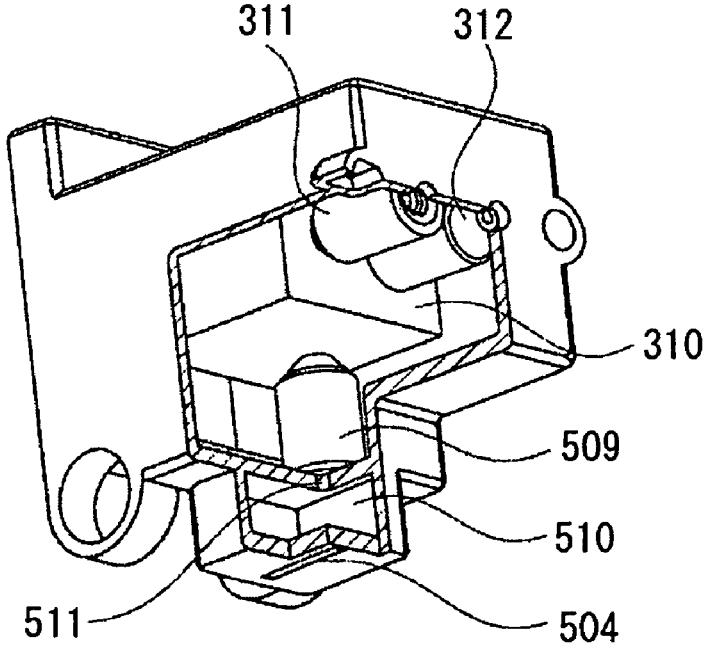

FIGS. 5A and 5B are perspective and partial sectional diagrams illustrating the carrier 206. The carrier 206 is guided to move reciprocally by bearings 502 and 503 guided by the shaft 207 and the guide 205 of the chassis 201.

An inkjet printing mechanism 504 is provided with an array of minute nozzles and includes an energy generating element for generating discharge pressure corresponding to each nozzle. The energy generating element is controlled to discharge ink from the corresponding nozzle based on a control signal sent from the control circuit 700 via a wiring line (not shown).

The carrier 206 includes a negative pressure port 505, an ink supply port 506, and holes 507 and 508 for adjusting a position with positioning bosses 317 and 318 of the main-body side supply mechanism 301.

A negative pressure valve 509 controls a flow rate of an ink from a sub-tank 310 into an ink buffer chamber 510 of the inkjet printing mechanism 504 and is connected to the ink buffer chamber 510 through the communication port 511.

A configuration of the negative pressure valves 309, 311, 312, and 509 is similar to that of FIGS. 4A and 4B and their characteristics can be changed by a spring.

Figure 6A:
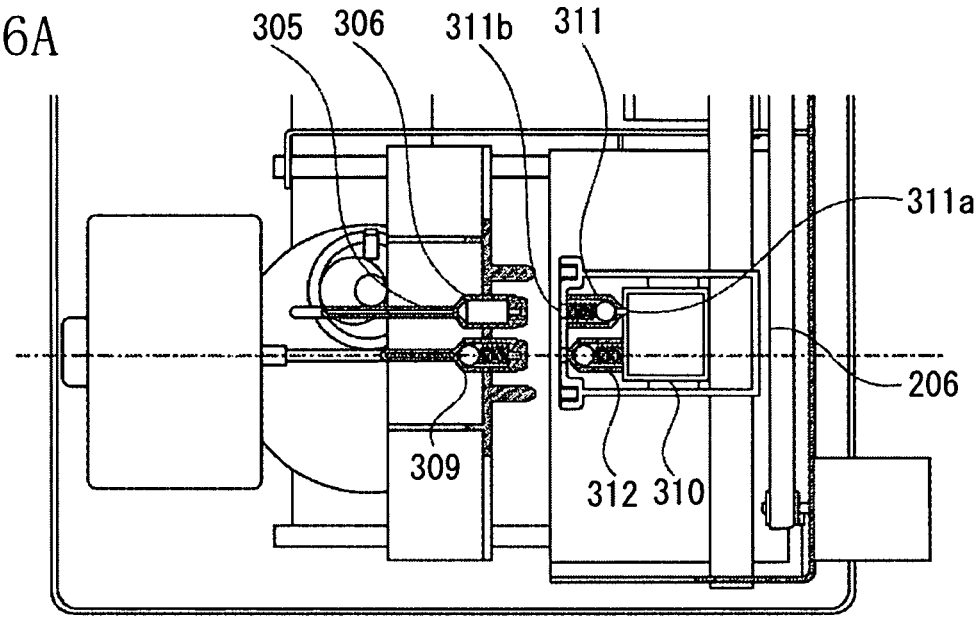
FIGS. 6A and 6B are plan and partial sectional diagrams illustrating the printing apparatus according to the exemplary embodiment of the present invention.
Figure 6B:
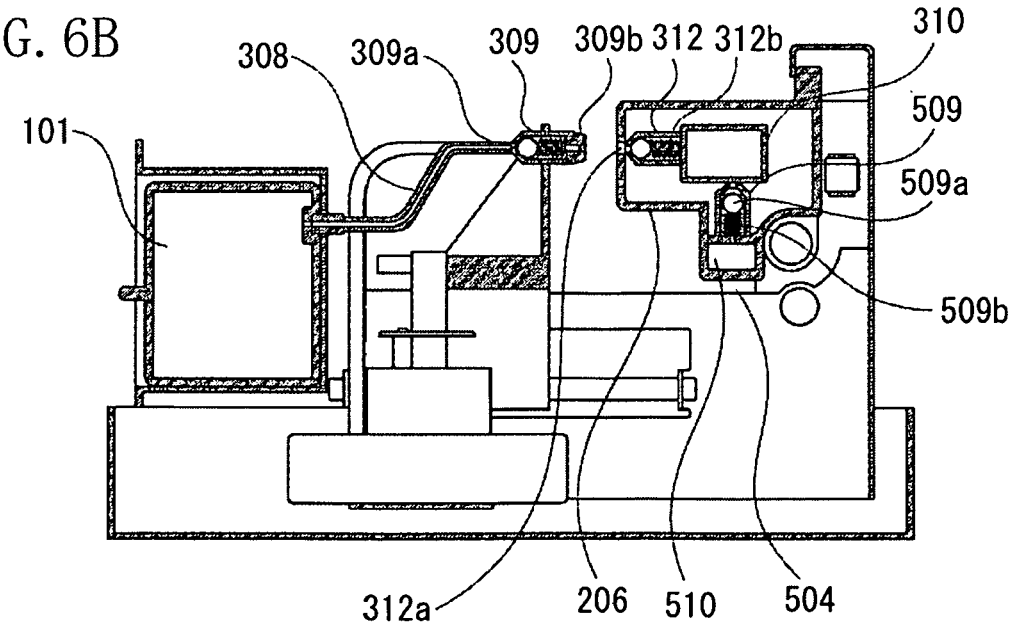

FIGS. 6A and 6B are plan and partial sectional diagrams of the printing apparatus 1.

Each of FIGS. 6A and 6B illustrates the carrier 206 that reciprocates in the arrow direction B of FIG. 2, and the inkjet printing mechanism 504 performs printing on the print sheet 906.

When the inkjet printing mechanism 504 consumes the ink in the ink buffer chamber 510, pressure within the ink buffer chamber 510 becomes negative. When the negative pressure reaches a certain value, a spherical valve 509*a* of the negative pressure valve 509 compresses a spring 509*b* to make an opening, thereby supplying an ink from the sub-tank 310 into the ink buffer chamber 510.

When the ink of the sub-tank 310 is reduced to produce negative pressure therein, and the negative pressure reaches a certain value, a spherical valve 312*a* of the negative pressure valve 312 opens to cause an atmosphere to flow in. When flowing-in of the atmosphere reaches a certain extent, a spring 312*b* of the negative pressure valve 312 closes the spherical valve 312*a*. The negative pressure is maintained in the sub-tank 310 and no ink leakage occurs. The negative pressure valve 311 is not opened by the negative pressure on the sub-tank 310 side. Accordingly, no ink leakage occurs from this valve.

Figure 7A:
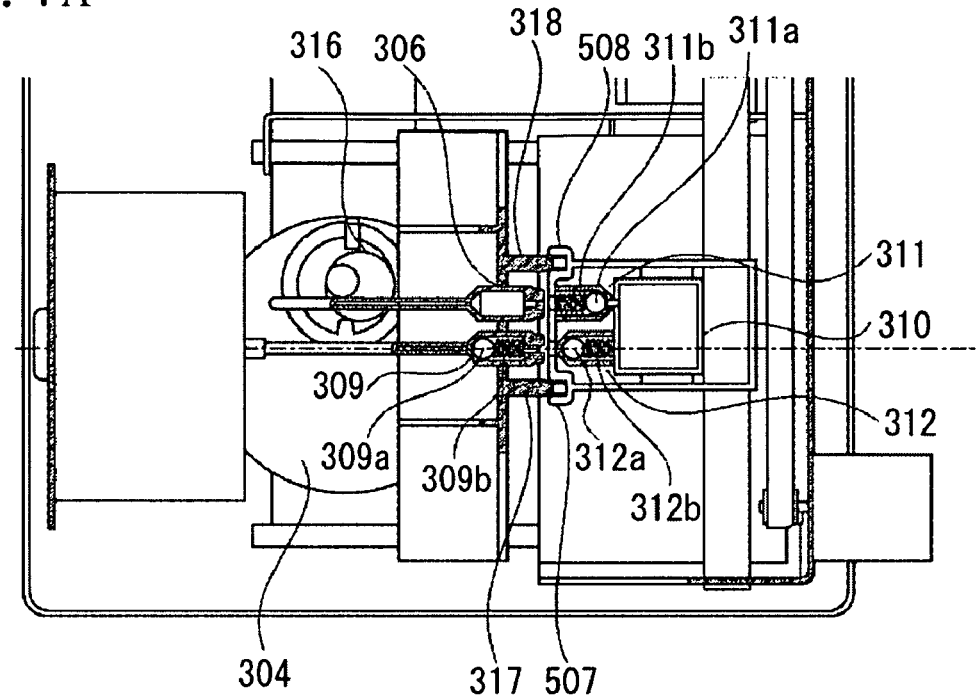
FIGS. 7A and 7B are plan and partial sectional diagrams illustrating the printing apparatus according to the exemplary embodiment of the present invention.
Figure 7B:
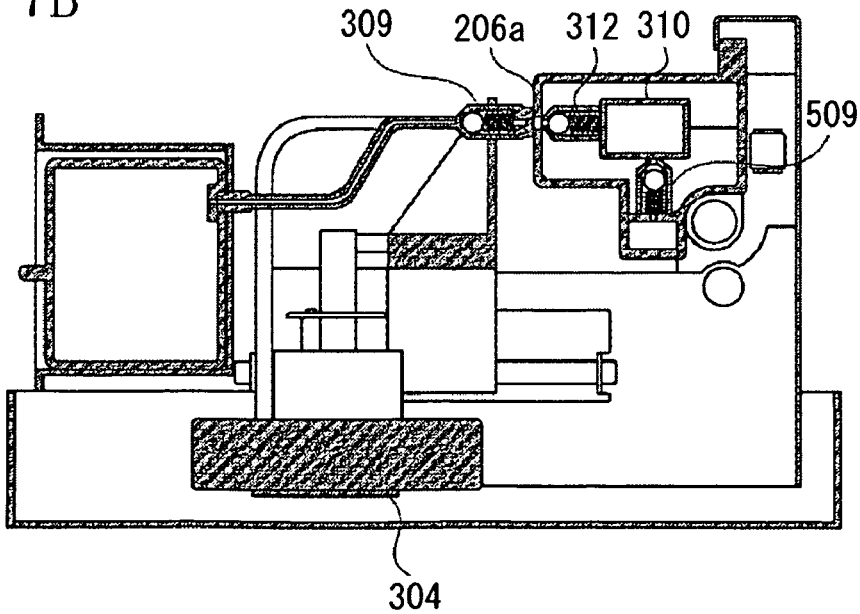

FIGS. 7A and 7B are plan and partial sectional diagrams of the printing apparatus 1. Each of FIGS. 7A and 7B illustrates the negative pressure connection unit 306 and the negative pressure valve 309 that abut on the backside 206*a* of the carrier 206 to respectively connect to the negative pressure port 505 and the ink supply port 506. If the carrier 206 is stopped in a predetermined position, the main-body side supply mechanism 301 is moved to the carrier 206 side by rotation of the connection cam 316. The positioning bosses 317 and 318 of the main-body side supply mechanism 301 are engaged with the positioning holes 507 and 508 to position the main-body side supply mechanism 301 and the carrier 206 relative to each other. When the main-body side supply mechanism 301 is further moved, the negative pressure connection unit 306 and the negative pressure valve 309 respectively connect to the negative pressure port 505 and the ink supply port 506.

Alternatively, the ink supply port 506 may be moved to connect to the negative pressure valve 309.

In this state, the pump 304 is operated to generate negative pressure that is higher than presumed negative pressure in the sub-tank 310, and applies negative pressure to the negative pressure valve 311 via the negative pressure connection unit 306. Because of this negative pressure, a spring 311*b* of the negative pressure valve 311 loses out to negative pressure of the negative pressure connection unit 306 side so that a spherical valve 311*a* is opened, thereby increasing negative pressure in the sub-tank 310.

When the negative pressure of the sub-tank 310 is increased, the negative pressure causes a spherical valve 312*a* of the negative pressure valve 312 to compress a spring 312*b* to make an opening. That is, the negative pressure valve 312 is opened because pressure of an opposite side is smaller than the ink supply port 506 side of the negative pressure valve 312 by a predetermined or more than a predetermined amount. Further, negative pressure applied from the opened negative pressure valve 312 causes a spherical valve 309*a* of the negative pressure valve 309 to compress a spring 309*b* to make an opening. That is, the negative pressure valve 309 is opened because pressure of an opposite side is larger than an opening 404*d* side of the negative pressure valve 309 by a predetermined or more than a predetermined amount. As a result, the ink tank 101 is connected to the sub-tank 310 in the negative pressure state, and ink flows from the ink tank 101 into the sub-tank 310.

In this case, on the inkjet printing mechanism 504 side, the negative pressure valve 509 serves as a check valve that prevents reverse flowing of the ink or flowing-in of air from the nozzles of the inkjet printing mechanism 504.

According to the exemplary embodiment, a path of fluids from the supply port 307 connected to the ink tank 101 through the tube 308 to the negative pressure valve 309 corresponds to a first flow path. A path of fluids from the ink supply port 506 through the negative pressure valve 312 to the sub-tank 310 corresponds to a second flow path. The negative pressure of the sub-tank 310 opens the negative pressure valves 312 and 309 to cause the first and second flow paths to communicate with each other. Thus, the connection cam 316 and the pump 304 constitute a flow path connecting device. The connection cam 316 interconnects or separates the negative pressure valve 309 at the end of the first flow path and the supply port 307 at the end of the second flow path from each other. The pump 304 opens the negative pressure valves 312 and 309 to cause the first and second flow paths to communicate with each other.

When the predetermined amount of ink is supplied to the sub-tank 310, the main-body side supply mechanism 301 is separated from the carrier 206 side by rotation of the connection cam 316 to move to positions illustrated in FIGS. 6A and 6B.

A phenomenon of ink scattering is observed when the sealing member 404 of the negative pressure valve 309 is separated from the backside 206*a* of the carrier 206 during a separation operation of the main-body side supply mechanism 301 from the carrier 206. As the ink flows through the negative pressure valve 309, the ink remains around the communication port 404*a* and scatters in association with the separation operation. A space of a predetermined volume is present between the opening 404*d* of the sealing member 404 of the negative pressure valve 309 and the ink supply port 506 of the backside 206*a* of the carrier 206 and the ink scatters to the space during the separation.

The scattered ink contaminates the print sheet 906. Moreover, an operation of each unit becomes unstable if the scattered ink is fixed.

The inventors have found out by experiment that almost no ink scattering occurs if the relative speed of the negative pressure valve 309 and the backside 206*a* of the carrier 206 is equal to or less than a predetermined speed at the time that the valve 309 and the carrier 206 are separated.

The inventors have also found out that the speed needs to be equal to or less than the above relative speed only within a predetermined distance from an abutting position and the speed can be increased without problems outside the predetermined distance.

Figure 1A:
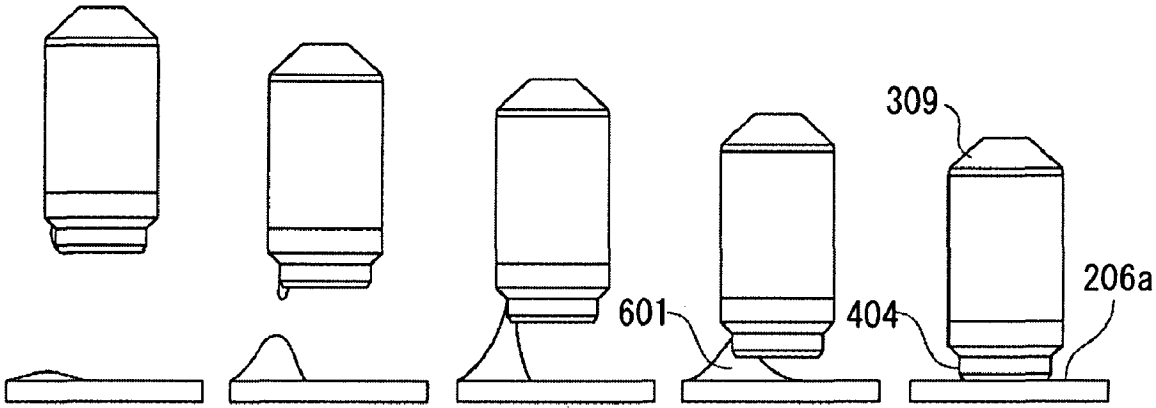
FIGS. 1A and 1B are diagrams illustrating behavior of ink.
Figure 1B:
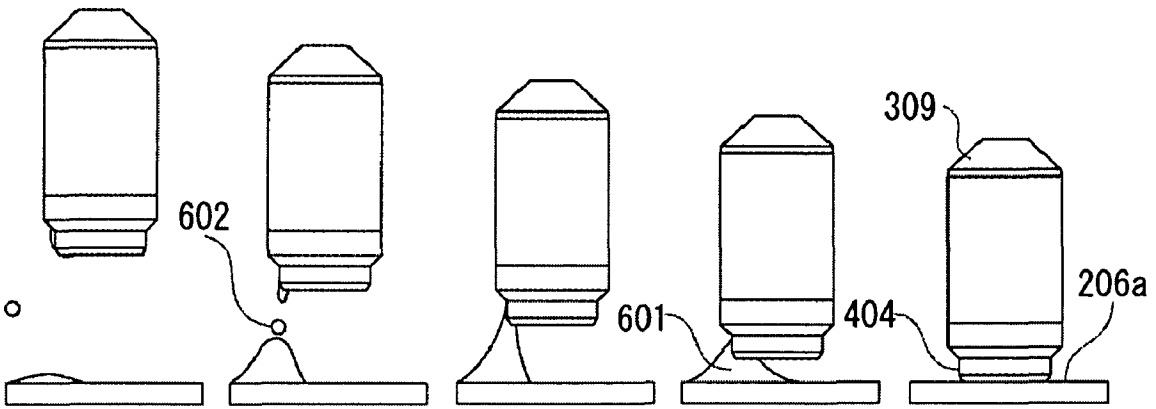

FIGS. 1A and 1B illustrate the ink behavior when the sealing member 404 of the negative pressure valve 309 is separated from the abutting backside 206*a* of the carrier 206. FIG. 1A illustrating a case in which a separation speed is 20 mm/second or less and FIG. 1B illustrating a case in which a separation speed is higher than 20 mm/second.

According to the exemplary embodiment, as connection is made in a horizontal direction, the ink left around the communication port 404*a* side is collected in the lower side of the sealing member 404 under the influence of gravity.

In the case of separation at the speed of 20 mm/second and less, the ink collected in the lower side of the sealing member 404 is pulled to both sides while forming a bridge 601 between the sealing member 404 and the backside 206*a* of the carrier 206. When the bridge is cut off, almost all of the ink is sucked by either side and thus little ink scattering occurs.

In the case of separation at the speed higher than 20 mm/second, the ink collected in the lower side of the sealing member 404 is also pulled to both sides while forming a bridge between the sealing member 404 and the backside 206*a* of the carrier 206. However, in this case, since the separation speed is high, a bridge cutoff state is unstable, and ink droplets 602 which are not sucked to neither side are left and scatter.

The inventors have confirmed that the ink bridge is cut off when a distance (separation distance) between the sealing member 404 and the backside 206*a* of the carrier 206 is approximately 4 mm according to the exemplary embodiment.

Figure 8A:
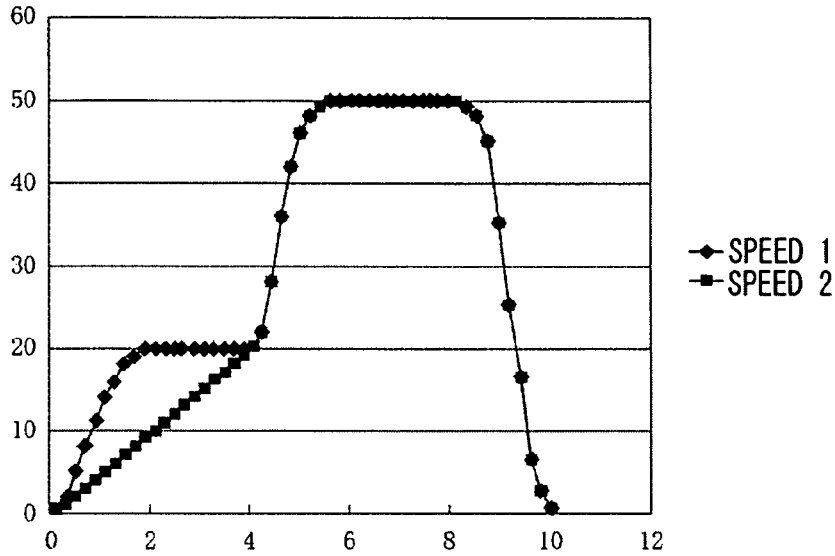
FIGS. 8A and 8B are graphs illustrating speed control and operation control according to the exemplary embodiment of the present invention.
Figure 8B:
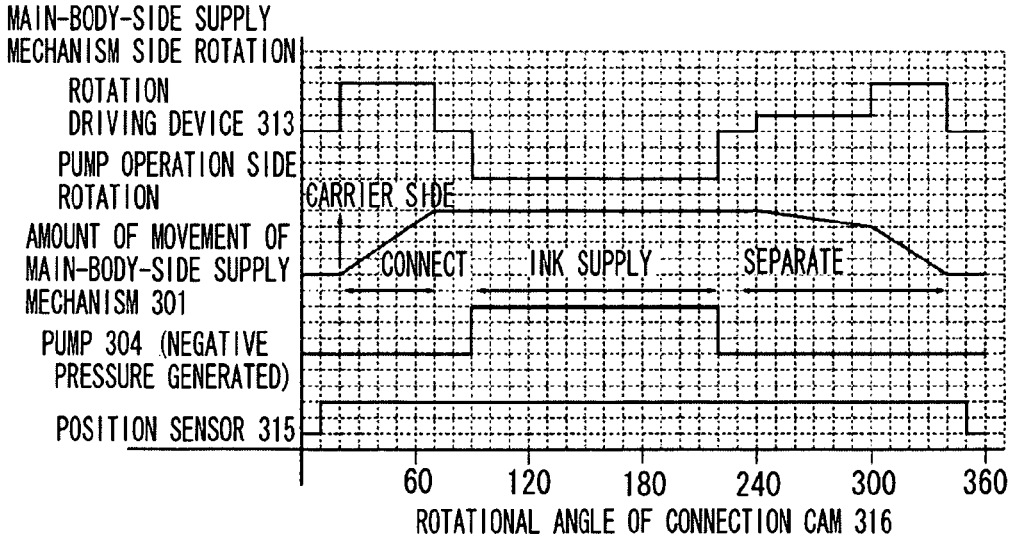

FIGS. 8A and 8B illustrate an example of speed control devised based on the experiment results. According to the illustrated example, the speed control is performed to prevent scattering of ink droplets when the negative pressure valve 309 is separated from the backside 206*a* of the carrier 206. FIG. 8A is a graph illustrating the relation between separation distance and speed.

When the separation distance is approximately 4 mm or less after the separation starts, the moving speed of the negative pressure valve 309 is controlled to be 20 mm/second or less. When the separation distance exceeds approximately 4 mm, no ink scatters. Accordingly, the negative pressure valve 309 can be moved at a speed higher than 20 mm/seconds. According to the exemplary embodiment, the speed is accelerated up to 50 mm/second.

In the graph labeled speed 1 in FIG. 8A, the speed of the negative pressure valve 309 is increased to 20 mm/second before a separation distance reaches 4 mm. The negative pressure valve 309 is moved at a constant speed of 20 mm/second until the separation distance reaches 4 mm. When the separation distance exceeds 4 mm, the speed is increased to 50 mm/second.

In the graph of a speed 2, the speed of the negative pressure valve 309 is increased under constant acceleration so that the speed reaches 20 mm/second when the separation distance reaches approximately 4 mm. When the separation speed exceeds 4 mm, the speed is increased up to 50 mm/second under higher acceleration. No ink scattering was observed when control was performed at both the speeds 1 and 2.

The ink examined according to the exemplary embodiment has a normal viscosity of 3.3 (mPa·/S) at a normal temperature and surface tension of 31 (mN/m). In a low-temperature environment, the viscosity and the surface tension increase by 1.5 times. However, no change occurred in separation conditions. Thus, similar effects can be achieved in fluids whose viscosity is 4 mPa/seconds or less. Similar effects can also be achieved in fluids whose surface tension is 40 mN/m or less.

The sealing member 404 has a diameter of 5.5 mm as normal. However, due to variations of the components of the device, no change in separation conditions was observed up to about 6 mm. Accordingly, similar effects can be achieved if a diameter of a sealing surface of the sealing member 404 is 6 mm or less.

For the sake of brevity, the exemplary embodiment has been described in term of one color. The exemplary embodiment can also be applied to multiple colors without any problems. In that case, however, when a diameter of the sealing member 404 exceeds approximately 6 mm, the size of the carrier may have to increase.

FIG. 8B is a chart collectively illustrating operations of each element with respect to a rotational angle of the connection cam 316. The operations of the exemplary embodiment are completed by one rotation of the connection cam 316.

In FIG. 8B, when an ink supply operation is started, the control circuit 700 rotates the connection cam 316 by the rotation driving device 313. When the connection cam 316 forms a rotational angle of 10°, a signal of the position sensor 315 is switched from a low level (L) to a high level (H). At a rotational angle of 20°, the connection cam 316 starts movement of the main-body side supply mechanism 301. At a rotational angle of 70°, as illustrated in FIGS. 7A and 7B, the negative pressure connection unit 306 and the negative pressure valve 309 are respectively connected to the negative pressure port 505 and the ink supply port 506, and the main-body side supply mechanism 301 stops. At a rotational angle of 90°, the control circuit 700 drives the pump 304 by the rotation driving device 313 to supply the ink from the ink tank 101 to the sub-tank 310. At a rotational angle of 220°, the pump 304 is stopped and the ink supplying is finished. From a rotational angle of 240°, the connection cam 316 separates the main-body side supply mechanism 301 from the carrier 206. During a predetermined period from rotational angles of 240° to 300° of the connection cam 316, the main-body side supply mechanism 301 moves at a speed of 20 mm/seconds. When the connection cam 316 forms a rotational angle of 300°, a distance (separation distance) between the sealing member 404 and the backside 206*a* of the carrier 206 is 4 mm. Between rotational angles of 300° and 340° after the predetermined period lapses, the main-body side supply mechanism 301 moves at a speed of 50 mm/seconds. At a rotational angle of 350°, the signal of the position sensor 315 is switched from H to L. The control circuit 700 controls the rotation driving device 313 to stop the connection cam 316 in response to the signal of the position sensor 315.

According to the exemplary embodiment, the moving speed of the main-body side supply mechanism 301 is controlled based on the shape of the cam. However, the main-body side supply mechanism 301 may be driven and moved by the motor and the moving speed may be controlled by regulating a rotational speed of the motor. That is, during a predetermined period until a distance (separation distance) between the sealing member 404 and the backside 206*a* of the carrier 206 becomes 4 mm, the motor is driven at a first rotational speed. After a lapse of the predetermined period, the motor is driven at a second rotational speed that is higher than the first rotational speed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-175294 filed Jul. 3, 2007, which is hereby incorporated by reference herein in its entirety.

What is claimed is:

1. A flow path connecting device comprising:

a first flow path having a first connector and configured to channel fluids;

a second flow path having a second connector and configured to channel fluids;

a moving unit operable to move at least one of the first and second connectors, to interconnect the first and second connectors so that the first and second flow paths are communicated with each other, and operable to move at least one of the first and second connectors to separate the first and second connectors from each other; and a control unit configured to control the moving unit, when the first and second connectors separate from each other, to set a relative speed of the first and second connectors to a first speed or less in a period from a start of the separation till a predetermined time expires, and set the relative speed to a second speed that is higher than the first speed after the predetermined time expires.

2. The flow path connecting device according to claim 1, wherein the first connector includes a first surface having a first opening which is an end of the first flow path, the second connector includes a second surface having a second opening which is an end of the second flow path, and the moving unit causes the first and second surfaces to abut on each other so that the first and second flow paths communicate with each other.

3. The flow path connecting device according to claim 2, wherein the first surface is a sealing surface.

4. The flow path connecting device according to claim 2, wherein the first connector includes a first valve for closing the first flow path, the second connector includes a second valve for closing the second flow path and, when the first and second connectors are separated from each other, the first and second valves are closed.

5. The flow path connecting device according to claim 4, wherein the first flow path includes a predetermined inner volume between the first valve and the first opening.

6. The flow path connecting device according to claim 5, wherein the second valve is opened when pressure at a side opposite to the second opening is smaller than pressure of the second opening side by a value equal to or larger than a predetermined value.

7. The flow path connecting device according to claim 6, wherein the first valve is opened when pressure at a side opposite to the first opening is larger than pressure of the first opening side by a value equal to or larger than a predetermined value.

8. The flow path connecting device according to claim 1, wherein the first speed is 20 mm/second.

9. The flow path connecting device according to claim 1, wherein the predetermined time is the time to separate the first and second connectors from each other by 4 mm.

10. The flow path connecting device according to claim 1, wherein the first and second flow paths are configured to channel a liquid.

11. The flow path connecting device as claimed in claim 10 in which the first and second flow paths are configured to channel a liquid having a surface tension of 40 mN/m or less.

12. The flow path connecting device according to claim 10, wherein the first and second flow paths are configured to channel a liquid having a viscosity of 4 mPa/seconds or less.

13. The flow path connecting device according to claim 3, wherein a diameter of the sealing surface is 6 mm or less.

14. A recording apparatus comprising:

a nozzle configured to discharge a liquid for recording in a recording medium;

a liquid chamber configured to store the liquid supplied to the nozzle;

a tank configured to store the liquid supplied to the liquid chamber;

a first flow path having a first connector and connected to the tank to let the liquid flow;

a second flow path having a second connector and connected to the liquid chamber to let the liquid flow;

a moving unit operable to move at least one of the first and second connectors, to interconnect the first and second connectors so that the first and second flow paths communicate with each other, and operable to move at least one of the first and the second connectors to separate the first and second connectors from each other; and a control unit configured to control the moving unit, when the first and second connectors separates from each other, to set a relative speed of the first and second connectors to a first speed or less in a period from a start of the separation till a predetermined time expires, and to set the relative speed to a second speed that is higher than the first speed after the predetermined time expires.

15. The recording apparatus according to claim 14, wherein the first connector includes a first surface having a first opening which is an end of the first flow path, the second connector includes a second surface having a second opening which is an end of the second flow path, and the moving unit causes the first and second surfaces to abut on each other so that the first and second flow paths are communicated with each other.

16. The recording apparatus according to claim 15, wherein the first surface is a sealing surface.

17. The recording apparatus according to claim 15, wherein the first connector includes a first valve for closing the first flow path, the second connector includes a second valve for closing the second flow path and, when the first and second connectors are separated from each other, the first and second valves are closed.

18. The recording apparatus according to claim 17, wherein the first flow path includes a predetermined inner volume between the first valve and the first opening.

19. The recording apparatus according to claim 17, wherein the second valve is opened when pressure at a side opposite to the second opening is smaller than pressure of the second opening side, by a value equal to or larger than a predetermined value.

20. The recording apparatus according to claim 14, wherein the first valve is opened when pressure at a side opposite to the first opening is larger than pressure of the first opening side by a value equal to or larger than a predetermined value.

21. The recording apparatus according to claim 20, further comprising a pressure reducing unit configured to reduce pressure in the liquid chamber, wherein the control unit controls the moving unit and the pressure reducing unit such that the first and second connectors are communicated with each other by the moving unit, the pressure of the liquid chamber is reduced by the pressure reducing unit to open the first and second valves, and the liquid stored in the tank is supplied to the liquid chamber owing to a pressure difference between the liquid chamber and the tank.

* * * * *